US007975385B2

(12) United States Patent
Obermann

(10) Patent No.: US 7,975,385 B2
(45) Date of Patent: Jul. 12, 2011

(54) HAIR-CUTTING APPARATUS COMPRISING MEANS FOR PREVENTING CUT HAIR FROM FLYING OFF

(75) Inventor: Wolfgang Johannes Obermann, St. Jakob (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 708 days.

(21) Appl. No.: 10/518,262

(22) PCT Filed: Jun. 18, 2003

(86) PCT No.: PCT/IB03/02770

§ 371 (c)(1),
(2), (4) Date: Dec. 16, 2004

(87) PCT Pub. No.: WO2004/002691

PCT Pub. Date: Jan. 8, 2004

(65) Prior Publication Data

US 2006/0053628 A1 Mar. 16, 2006

(30) Foreign Application Priority Data

Jun. 26, 2002 (EP) ..... 02100750

(51) Int. Cl.
*B26B 19/14* (2006.01)
*B26B 19/20* (2006.01)

(52) U.S. Cl. ..... 30/133; 30/30

(58) Field of Classification Search ..... 30/133, 30/30, 201, 31, 41.6, 41.5, 124, 134, 192, 30/195, 207, 208, 216, 199, 225, 527, 233.5, 30/202–206, 213, 301, 200; 132/213, 225; D28/58, 52–54; D32/5, 18; 15/344, 300.1, 15/330, 357

See application file for complete search history.

(56) References Cited

U.S. PATENT DOCUMENTS

| | | | | | |
|---|---|---|---|---|---|
| 1,506,139 | A * | 8/1924 | Severson | 30/133 |
| 2,323,046 | A * | 6/1943 | Jenkins | 30/133 |
| 2,496,613 | A * | 2/1950 | Woodward | 83/477.1 |
| 2,807,086 | A * | 9/1957 | Watkins | 30/133 |
| 2,914,849 | A * | 12/1959 | Watkins | 30/133 |
| 2,929,140 | A * | 3/1960 | Wilson | 30/133 |
| 2,946,122 | A * | 7/1960 | Gaskins | 30/133 |
| 2,946,123 | A * | 7/1960 | Bray | 30/219 |
| 3,302,286 | A * | 2/1967 | Zucker | 30/133 |
| 3,331,130 | A * | 7/1967 | Ligon | 30/133 |
| 3,447,577 | A * | 6/1969 | Burrows et. al. | 30/377 |
| 3,654,699 | A | 4/1972 | Garcia | |
| 4,030,196 | A * | 6/1977 | Koiwa et al. | 30/133 |
| 4,074,427 | A * | 2/1978 | Marchetti et al. | 30/34.1 |
| 4,843,717 | A | 7/1989 | Crane | |
| 5,153,994 | A * | 10/1992 | Emmett | 30/133 |
| 6,415,699 | B1 * | 7/2002 | Bettacchini et al. | 83/397 |
| 6,571,478 | B1 * | 6/2003 | Romani et al. | 30/133 |
| 7,076,878 | B2 * | 7/2006 | Degregorio, Jr. | 30/133 |
| 2002/0073549 | A1 * | 6/2002 | McCambridge et al. | 30/41.5 |

FOREIGN PATENT DOCUMENTS

JP 2001190871 A1 7/2001

* cited by examiner

*Primary Examiner* — Ghassem Alie

(57) ABSTRACT

A hair-cutting apparatus (1) includes a cutting arrangement (9) for cutting hair. There is provided an arrangement that prevents cut hair from flying off the hair-cutting apparatus and that includes a boundary wall (22). The boundary wall (22) extends close to the cutting arrangement (9) and includes a stationary portion (34) and a movable portion (35), the movable portion (35) being intended and arranged to cooperate with hair to be cut.

7 Claims, 2 Drawing Sheets

HAIR-CUTTING APPARATUS COMPRISING MEANS FOR PREVENTING CUT HAIR FROM FLYING OFF

The invention relates to hair-cutting apparatus comprising a cutting arrangement for cutting hair and comprising means for counter-acting flying off cut hair from the hair-cutting apparatus.

Hair-cutting apparatus of the kind specified in the first paragraph has been put on the market and is therefore known. In connection with hair-cutting apparatus of this kind, reference may be made to patent JP 2001-190.871 A. In the known designs of hair-cutting apparatus of this kind, the means for preventing cut hair from flying off are formed by a suction arrangement, which arrangement has a suction passage that extends to a point close to the cutting arrangement and that ends there in a suction opening through which air can be sucked into the suction passage at a given velocity of flow in a direction of suction, the intention being for cut hair to be prevented from flying off by the flow of air that is generated. In the known designs, only one fixed velocity of flow that is preset at a nominal figure can be obtained in the region of the suction opening with the suction arrangement. Unfortunately, it has been found with the known designs that with different hair characteristics, different densities of hair and different lengths of hair, the results that can be obtained in respect of the prevention of cut hair from flying off are sometimes unsatisfactory, which unfortunately means that with many types and conditions of hair a relatively large amount of cut hair flies off the hair-cutting apparatus and hence dirties the surroundings.

It is an object of the invention to overcome the problems stated above and to produce an improved hair-cutting apparatus.

To achieve the above object, features according to the invention are provided in a hair-cutting apparatus according to the invention such that hair-cutting apparatus according to the invention can be characterized in the manner specified below, namely:

Hair-cutting apparatus comprising a cutting arrangement for cutting hair and comprising means for counter-acting flying off cut hair from the hair-cutting apparatus, which means comprising a boundary wall, which boundary wall extends close to the cutting arrangement and which boundary wall comprising a stationary portion and a portion that is movable relative to the stationary portion, the movable portion being arranged and positioned to cooperate with the hair to be cut.

The provision of the features according to the invention affords, in a manner that is relatively easy and space-saving and with only a small amount of additional cost and complication, a useful possible way of, in an improved manner, preventing cut hair from flying off the hair-cutting apparatus according to the invention, because a sort of protective shield, which very effectively prevents cut hair from flying off, is formed by means of the movable portion of the boundary wall and by means of the hair to be cut that cooperates with the said movable portion.

In hair-cutting apparatus according to the invention, the movement of the movable portion can be performed by hand, for example by means of a sliding button that acts on the movable portion. It has however proved particularly advantageous if the features detailed in claim 2 are also provided. This makes it possible for the means that prevent cut hair from flying off to be moved and adjusted automatically as a function of the hair to be cut.

In the hair-cutting apparatus according to the invention that is detailed in the previous paragraph, it has proved highly advantageous if the features detailed in claim 3 are also provided. An embodiment that is particularly safe and reliable in operation, space-saving and easy to operate is obtained in this way.

With regard to the resilient force exerted by the rod spring, it has been found particularly advantageous if, in hair-cutting apparatus according to the invention, the features detailed in claim 4 are also provided. By means of the rod spring, an opposing force that is of advantageous benefit is obtained in this way to the adjusting force that can be applied by means of hair to the movable and adjustable portion of the boundary wall.

In hair-cutting apparatus according to the invention it has further proved highly advantageous if the features detailed in claim 5 are also provided. In this way, additional support is provided for the action of the means formed by the movable and adjustable portion of the boundary wall, which means prevent cut hair from flying off, by the suction arrangement for sucking away cut hair, which suction arrangement can also be counted as part of the means that prevent cut hair from flying off.

In hair-cutting apparatus according to the invention as detailed in the previous paragraph it has proved particularly advantageous if the features detailed in claim 6 are also provided. What is achieved in this way is that the adjustable portion of the boundary wall performs a dual function.

These and other aspects of the invention are apparent from and will be elucidated with reference to the embodiment described hereinafter.

Figure 1:
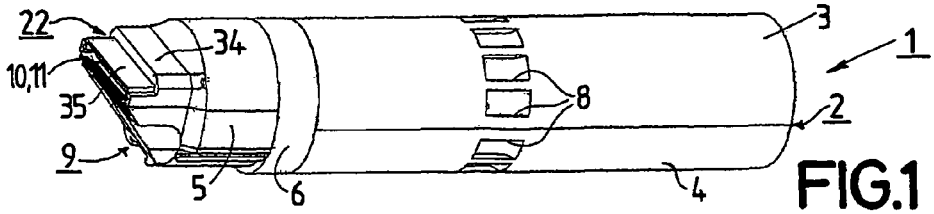
FIG. 1 is an oblique view from above showing an embodiment of hair-cutting apparatus according to the invention.
Figure 2:
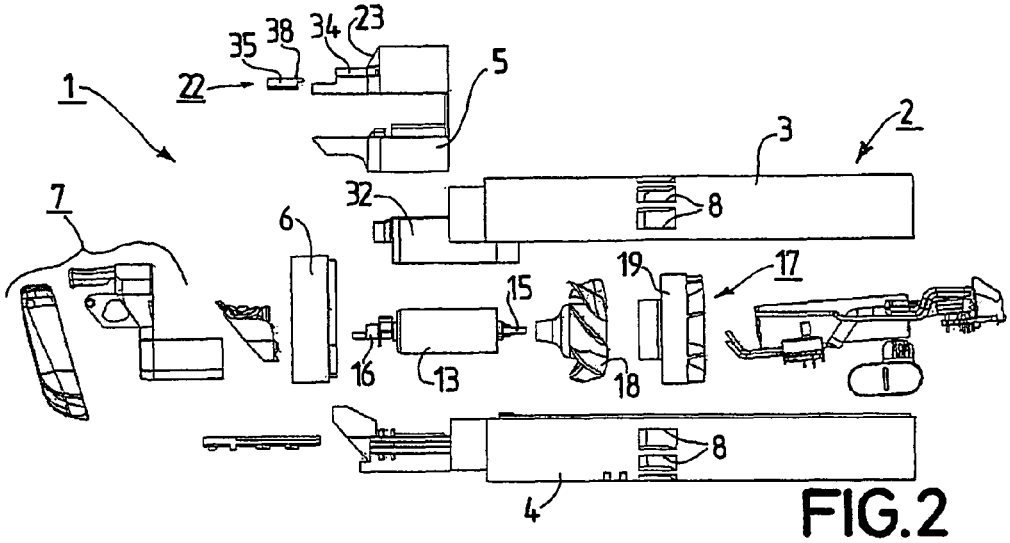
FIG. 2 is an exploded view showing the principal components of the hair-cutting apparatus of FIG. 1.
Figure 3:
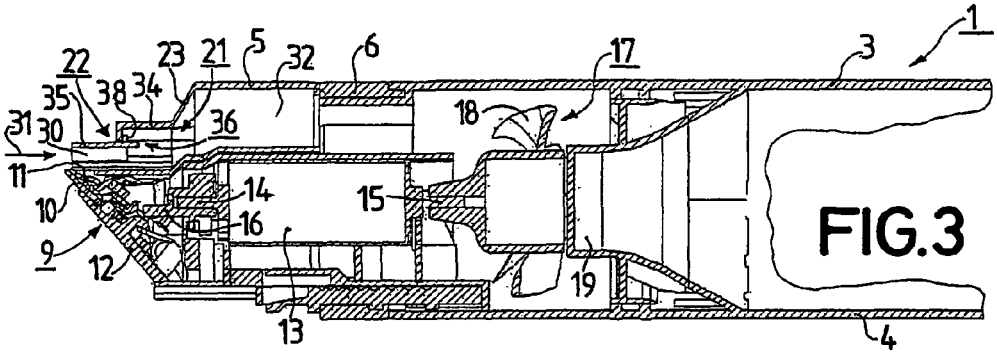
FIG. 3 is a cross-section through part of the hair-cutting apparatus of FIG. 1.

FIG. 1 shows a hair-cutting apparatus 1. The hair-cutting apparatus 1 has a housing 2 that comprises a top housing section 3, a bottom housing section 4 and a front housing section 5. Between the front housing section 5 and the other two housing sections 3 and 4 is provided an adjusting ring 6 by means of which, by rotating the same, a comb 7 of the hair-cutting apparatus, which is not shown in FIG. 1 but is shown in FIG. 2, can be adjusted parallel to the longitudinal direction of the hair-cutting apparatus 1, as is known per se. In this connection, reference may be made to patent document EP 0 325 326 B1, the disclosure of which is considered to be included here by virtue of this reference. Provided in the top housing section 3 and the bottom housing section 4, approximately in the central region thereof, are through-openings 8 through which air can flow out from the interior of the housing 2.

At that end of the front section 5 of the housing that is remote from the adjusting ring 6, the hair-cutting apparatus 1 is fitted with a cutting arrangement 9. The cutting arrangement 9 is intended and arranged to cut hair. The cutting arrangement 9 has two toothed cutter blades 10 and 11, the first toothed cutter blade 10 being held stationary on a carrier 12 of the toothed cutting arrangement 9, and the second toothed cutter blade 11 being guided to be movable to and fro, and being drivable to and fro, in relation to the first toothed cutter blade 10, as has long been known.

The hair-cutting apparatus 1 contains a motor 13 that has a first drive shaft 14 and a second drive shaft 15. Mounted on the first drive shaft 14 in such a way as to be secure in rotation therewith is a cam configuration 16. The cam configuration 16 is coupled to the second toothed cutter blade 11 in such a way that the second toothed cutter blade 11 can be driven to and fro by means of the cam configuration 16.

Figure 4:
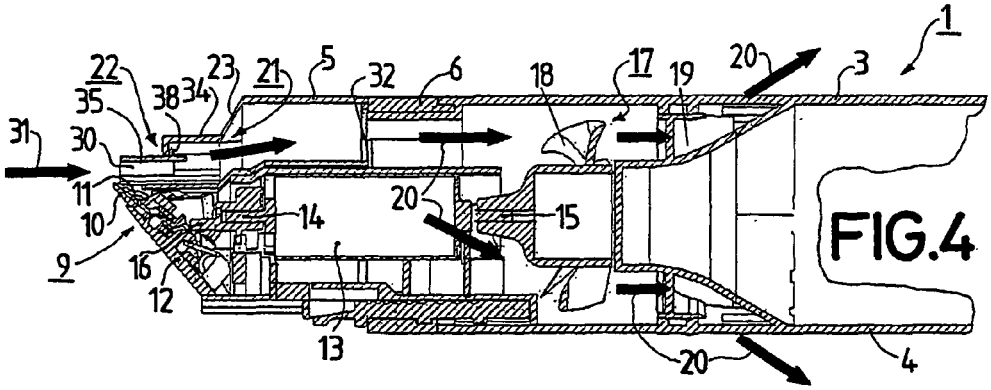
FIG. 4 shows the same part of the hair-cutting apparatus as in FIG. 3, in a similar way to FIG. 3, but with an air-flow that can be generated in the hair-cutting apparatus also shown.
Figure 5:
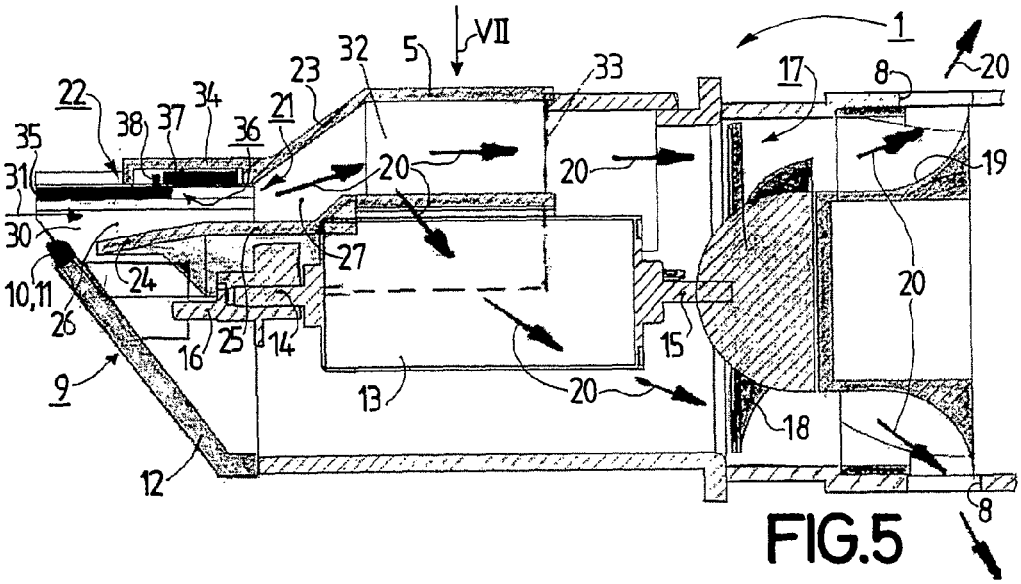
FIG. 5 shows the part of the hair-cutting apparatus that is shown in FIGS. 3 and 4 diagrammatically and to a scale that is larger than in FIG. 4.
Figure 6:
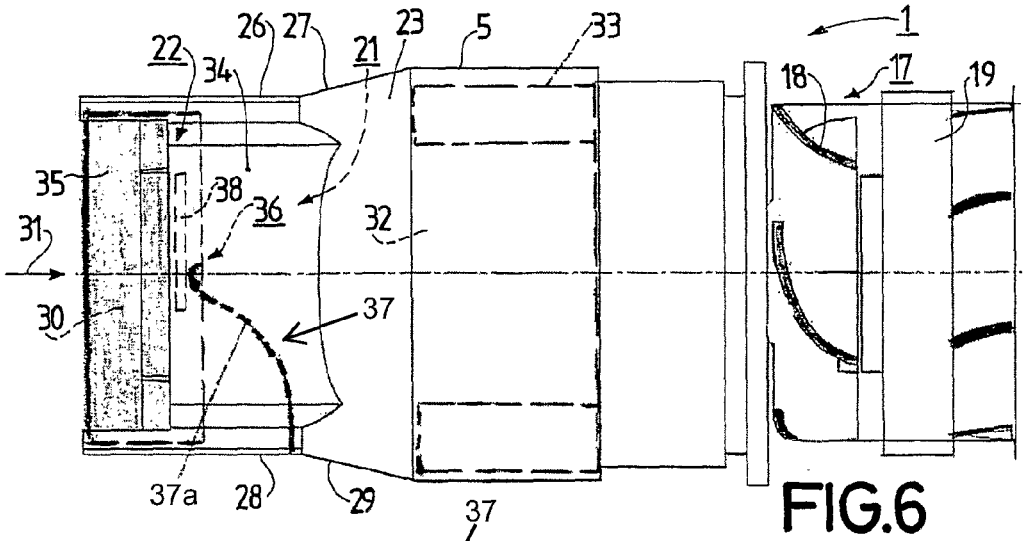
FIG. 6 shows the part of the hair-cutting apparatus that is shown in FIGS. 3 to 6 in a view looking in the direction of arrow VII in FIG. 5.

The hair-cutting apparatus 1 is further fitted with a suction arrangement 17. The suction arrangement 17 is intended and arranged to suck away cut hair. The suction arrangement 17 has a fan 18 that can be driven in rotation, that is mounted on the second drive shaft 15 in such a way as to be secure in rotation therewith and that is provided with additional support by an air baffle member 19. The fan 18 may however also be mounted to rotate by means of the drive shaft 15 alone, in which case the air baffle member 19 does not then perform a dual function. An air-flow that is indicated in FIGS. 4 and 5 by arrows 20 can be generated in the hair-cutting apparatus 1 by means of the fan 17. The air-flow is diverted by means of the air baffle member 19 to the through-openings 8. The suction arrangement 17 has a suction passage 21 that is bounded by passage walls 22, 23, 24, 25, 26, 27, 28 and 29. Of the passage walls, some, namely passage walls 22, 24, 26 and 28, extend to a point close to the cutting arrangement 9, i.e. to a point close to the two toothed cutter blades 10 and 11 of the cutting arrangement 9. At their ends situated close to the cutting arrangement 9, i.e. close to the toothed cutter blades 10 and 11, the four boundary walls 22, 24, 26 and 28 define a suction opening 30. Air can be sucked into the suction passage 21 through the suction opening 30 in a direction indicated by an arrow 31, at a velocity of flow that can advantageously be varied. Connecting up with the suction passage 21 is a collecting container 32 that is intended and arranged to collect cut hair. The collecting container 32 is provided with a filter 33 that is diagrammatically indicated in FIGS. 5 and 6. The cut hair is separated out of the flow of air by means of the filter 33, so that no cut hair is then contained downstream of the collecting container 32 in the flow of air that is emitted through the through-openings 8.

Figure 7:
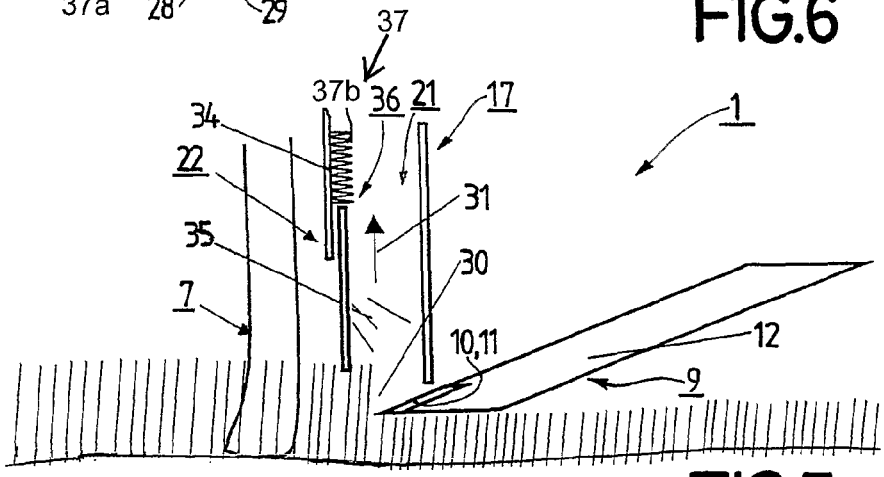
FIG. 7 shows the hair to be cut that cooperates with the hair-cutting apparatus shown in FIGS. 1 to 6, in a view that is completely diagrammatic.

In the hair-cutting apparatus 1, not only is the first passage wall 22, that also forms a boundary wall 22 of the hair-cutting apparatus 1, formed by a single stationary wall, but the design of the first passage wall 22 is also advantageously such that the first passage wall 22 comprises a stationary portion 34 and a portion 35 that can be moved and therefore adjusted relative to the stationary portion 34 and relative to all the passage walls 23 to 29, the adjustment taking place in this case in a straight line and, in this straight line, parallel to the direction of suction 31. The passage wall 35 may however also be arranged to be slightly curved and to be adjustably guided to follow the shape of the curve. At its free end, the movable and adjustable portion 35 defines the suction opening 30. In the case of the hair-cutting apparatus 1, the movable and adjustable portion 35 of the passage wall 22 forms part of varier means 36 that are provided to allow the air-flow to be varied in the region of the suction opening 30. The varier means 36 comprise the movable and adjustable portion 35 of the passage wall 22 and also a spring means 37 that cooperates with the adjustable portion 35 of the passage wall 22 and that can be see in FIG. 6. The spring means 37 loads the adjustable portion 35 in the opposite direction to the direction of suction 31 and attempts to hold the adjustable portion 35 in an initial position. The adjustable portion 35 of the passage wall 22 is intended and arranged to cooperate with hair to be cut, as is shown in a highly diagrammatic way in FIG. 7. When the adjustable portion 35 of the passage wall 22 is cooperating with hair to be cut, the said adjustable portion 35 is adjustable in opposition to the force exerted by the spring means 37, i.e., in the direction of suction 31, as indicated in FIG. 7. The amount by which the adjustable portion 35 is adjusted is dependent, in this case, on the nature and condition of the hair, i.e., on the density of the hair, the length of the hair, the thickness of the hair and the stiffness of the hair. As can be seen from FIG. 6, the spring means 37 is formed in the hair-cutting apparatus 1 by a leaf spring 37*a* that extends substantially transversely to the direction of suction 31, that extends in a curve, that is fastened in place in the region of the lateral passage wall 28 and the free, curved end of which cooperates with a strip 38 projecting from the portion 35. The spring means 37 may however alternatively be a rod-shaped (coil) spring 37*b* as shown in FIG. 7. The resilient force exerted by the spring means 37 is, nominally, approximately 40 mN. The resilient force exerted by the spring means 37 may be within a range of between 10 mN and 40 mN.

Regarding the leaf spring 37*a*, it should also be mentioned that the leaf spring 37*a* is the form of a so-called bent spring that, when the adjustable portion 35 is situated in its initial position, is shaped to a so-called bent parabola. When the adjustable portion 35 has been adjusted to the maximum extent from its initial position, the leaf spring 37 assumes a shape in which it extends almost in a straight line, although this is not shown in FIG. 6.

In the hair-cutting apparatus 1, the adjustable portion 35 of the passage wall 22 is also part of means that prevent cut hair from flying off from the hair-cutting apparatus 1, which means comprise the first passage wall 22 that also forms a boundary wall 22 of the hair-cutting apparatus 1. The means that prevent cut hair from flying off the hair-cutting apparatus 1 also comprise, in addition to the passage wall 22 having the adjustable portion 33, the spring means 37, the stationary portion 34 of the passage wall 22, and the other passage walls 24, 26 and 28.

What is achieved with the help of the adjustable portion 35 of the passage wall 22 is that the velocity of the air-flow in the region of the suction opening 30 is easily and automatically adjusted to the nature and condition of the hair at the time, the suction opening 30 being kept as small as possible as a function of the nature and condition of the hair at the time, i.e. of the amount of hair being fed in at the time for example, which results in a maximum velocity of flow always being obtained. This in turn produces resulting suction that is adjusted to the nature and condition of the hair at the time and thus is good.

In the initial state, the adjustable portion 35 of the passage wall 22 is held in the initial position shown in FIGS. 3 to 6 by means of the spring 37. In this case, the resilient force exerted by the spring 37 is advantageously sufficiently high to balance the weight of the adjustable portion 35 under all circumstances. The force exerted by the spring 37 is so high in this case that the adjustable portion 35 can be moved back to its initial position no matter what attitude the hair-cutting apparatus 1 is in. On the other hand, the force exerted by the spring 37 is only so high that, even when there are relatively few hairs cooperating with the adjustable portion 35, the adjustable portion 35 can still be adjusted in opposition to the force exerted by the spring 37. As can be seen from FIG. 7, the adjustable portion 35 is adjusted by the hair to be cut in the direction of suction 31, which ensures that the size of the suction opening is adjusted in the optimum way to the nature and condition of the hair that exist at the time.

What is also achieved in the hair-cutting apparatus 1 by means of the adjustable portion 35 of the passage wall 22, the stationary portion 34 of the passage wall 22 and the passage walls 24, 26 and 28 is that cut hair is prevented from flying off the hair-cutting apparatus 1 in a particularly effective and satisfactory manner. This means that virtually all the hair that is cut makes its way into the suction passage 21 and is sucked away by the suction arrangement 17, as is indicated diagrammatically in FIG. 7.

The invention claimed is:

1. A hair-cutting apparatus comprising: a housing containing a motor, said housing extending in a longitudinal direction; a cutting arrangement coupled to said motor for cutting hair, said cutting arrangement positioned at an end of the housing; and means for counter-acting flying off cut hair wall extending, in the longitudinal direction of the housing, said boundary forming an opening with respect to said cutting arrangement to receive cut hair, said boundary wall having a stationary portion and a portion that is movable relative to the stationary portion, wherein the movable portion being arranged and positioned to cooperate with the hair to be cut dependent on the nature and condition of the hair, the movable portion being movable by an adjusting force applied by the hair to the movable and adjustable portion of the boundary wall, said movement of the movable portion selectively enlarging said opening.

2. The hair-cutting apparatus as claimed in claim 1, wherein the means comprising a spring means cooperating with the movable portion of the boundary wall to spring-load the movable portion in the direction of the hair to be cut such that said opening has a minimum size, and wherein the movable portion being movable in opposition to the force exerted by the spring means when cooperating with hair to be cut.

3. The hair-cutting apparatus as claimed in claim 2, wherein the spring means comprise a leaf spring extending substantially transversely to the direction of movement of the movable portion, said leaf spring extending in a curve when said movable portion is positioned such that said opening has said minimum size.

4. The hair-cutting apparatus as claimed in claim 3, wherein the resilient force exerted by the leaf spring is within a range of 10 mN and 50 mN.

5. The hair-cutting apparatus as claimed in claim 1, wherein a suction arrangement is provided to suck away the cut hair, said suction arrangement comprising a suction passage that is defined by passage walls, at least some of which extend close to the cutting arrangement and the ends of which situated close to the cutting arrangement define a said opening through which air can be sucked into the suction passage in a direction of suction at a given velocity of flow, and wherein one of the passage walls is formed by the boundary wall having the stationary portion and the movable portion.

6. The hair-cutting apparatus as claimed in claim 5, wherein the suction arrangement comprising varier means for varying the velocity of air flow in the region of the opening, and wherein the varier means are formed by the movable portion of the boundary wall varying the size of the opening.

7. The hair-cutting apparatus as claimed in claim 1, wherein said hair-cutting apparatus further comprises a suction arrangement substantially contained in the apparatus.

* * * * *